US005192169A

United States Patent [19]

Landsberg

[11] Patent Number: 5,192,169

[45] Date of Patent: Mar. 9, 1993

[54] FRICTION ROCK STABILIZER

[75] Inventor: Thomas J. Landsberg, Princeton, N.J.

[73] Assignee: Simmons-Rand Company, Bristol, Va.

[21] Appl. No.: 790,626

[22] Filed: Nov. 12, 1991

[51] Int. Cl.[5] ..... E21D 21/00

[52] U.S. Cl. ..... 405/259.1; 411/452

[58] Field of Search ..... 405/259.1, 259.2, 259.3, 405/259.5, 259.6; 411/451, 452

[56] References Cited

U.S. PATENT DOCUMENTS

| | | | |
|---|---|---|---|
| 4,147,458 | 4/1979 | Elders | 405/259.1 |
| 4,316,677 | 2/1982 | Ciavatta . | |
| 4,322,183 | 3/1982 | Ciavatta . | |
| 4,523,880 | 6/1985 | Isler | 405/259.1 |
| 4,650,373 | 3/1987 | Seegmiller | 405/259.1 X |
| 4,661,022 | 4/1987 | Seegmiller . | |
| 4,666,345 | 5/1987 | Seegmiller | 405/259.1 X |
| 4,826,358 | 5/1989 | Brustrom | 405/259.1 |

FOREIGN PATENT DOCUMENTS 514153 12/1980 Australia .

*Primary Examiner*—David H. Corbin
*Attorney, Agent, or Firm*—John J. Selko

[57] ABSTRACT

A friction rock stabilizer includes a center spine, a plurality of arms extending radially outwardly therefrom, for urging a plurality of friction surfaces into resilient contact with a borehole wall. The friction surfaces are positioned on an arc of a circle measured around the center axis of the borehole, which arc spans a center angle of at least 180 degrees.

11 Claims, 4 Drawing Sheets

FRICTION ROCK STABILIZER

BACKGROUND OF THE INVENTION

This invention relates generally to friction rock stabilizers and particularly to friction rock stabilizers for forced insertion thereof into an undersized bore in an earth structure, such as a mine roof or wall.

One type of friction rock stabilizer uses a slit along its length to provide compressibility.

The use of slitted friction rock stabilizers to stabilize the rock layers in the roofs and walls of mines, tunnels and other excavations is well known. In application, these devices provide the benefit of relatively easy installation and a tight grip, which grows stronger with time and as rock shifts. A problem associated with these prior art stabilizers is that their weight and bulk contribute to manufacturing and shipping costs, and also can cause handling problems underground. Also such stabilizers, if made from carbon steel, can be subject to corrosion over time.

The foregoing illustrates limitations known to exist in prior art stabilizers. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the invention this is accomplished by providing a friction rock stabilizer having an elongated center spine adapted to extend within a borehole adjacent to the longitudinal center axis of the borehole. Support arms extend transversely outwardly from the spine, for resiliently urging at least three spaced-apart friction surfaces into contact with the borehole wall, the friction surfaces being positioned on an arc of a circle measured around the center axis of the borehole, the arc spanning a center angle of at least 180 degrees. The support arms are resiliently compressible during insertion of the stabilizer into an undersized borehole.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
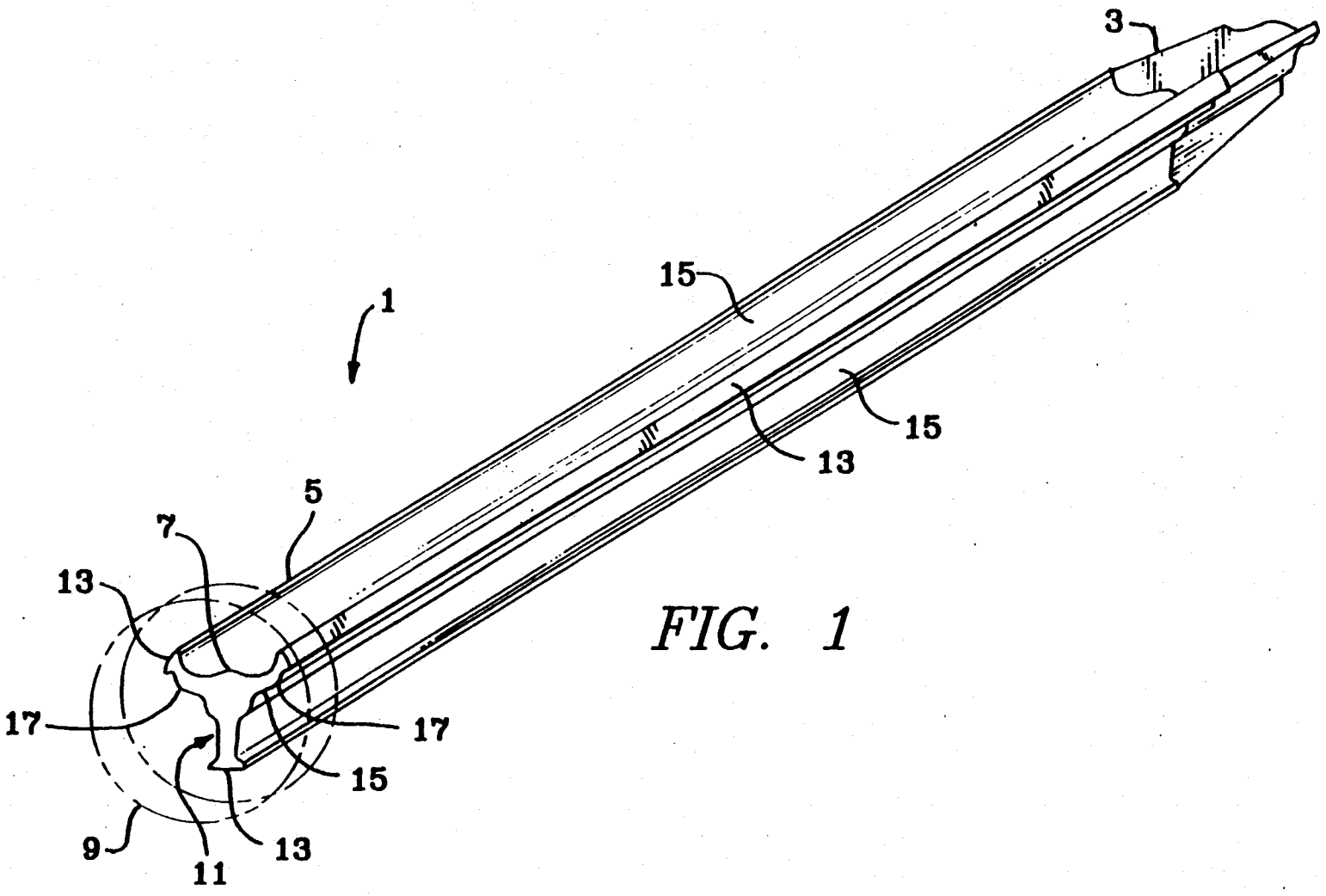
FIG. 1 is a perspective view of the stabilizer of the invention, with a bottom flange shown in phantom.

Referring to FIG. 1, there is shown the stabilizer 1, for use in a conventional borehole (not shown). As is well known, the borehole has a longitudinal center axis, with the borehole wall spaced around the axis to form an opening having a substantially circular cross section, when viewed in a plane transverse to the center axis.

Figure 4:
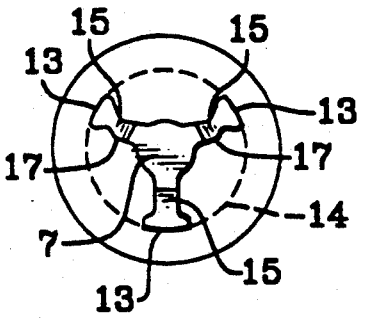
FIG. 4 is a top plan view of the stabilizer of the invention with the borehole wall shown in a dotted line.

Stabilizer 1 includes a top end 3, a bottom end 5 and an elongated center spine 7 extending between top end 3 and bottom end 5. Top end 3 is tapered to facilitate insertion of that end into a borehole. Bottom end 5 has affixed thereto a flange 9 that is larger than the borehole diameter. Spine 7 is adapted to extend within the borehole adjacent to, or coinciding with, the longitudinal axis of the borehole. Extending transversely outwardly from spine 7 is support arm means, shown generally as 11, for urging at least three spaced-apart friction surfaces 13 into resilient contact with the borehole wall, when the stabilizer 1 is forced into an undersized borehole. As seen in FIG. 4, when friction surfaces 13 contact the borehole wall 14, they have therebetween a portion of spine 7 spaced from the borehole wall 14, as is apparent when the invention is viewed in a plane transverse to the longitudinal axis of the borehole.

Extending between each friction surface 13 and center spine 7 is a support arm 15. Each support arm 15 extends radially and outwardly from spine 7, when viewed in a plane transverse to the center axis of the borehole. Each support arm 15 is resiliently compressible in a direction toward spine 7, during insertion of stabilizer 1 into an undersized borehole. It should be understood that arms 15 are adapted to transmit the compressive stress in a radial direction between surfaces 13 and spine 7, when viewed in a plane transverse to the center axis of the borehole.

The resilient compression of arms 15 is facilitated by providing an angularly bent elbow portion 17 in arm 15, between surface 13 and spine 7, at which resilient bending can occur. I prefer to form the elbow 17 in two of the three support arms 15, with one of the support arms 15 being straight, without the below 17. Alternatively, all or none of the arms 15 may have the elbow 17, so long as at least one support arm 15 is compressible toward spine 7 upon insertion of stabilizer 1 into an undersized borehole.

Support arm 15 are spaced around spine 7 so that the friction surfaces 13 contact the borehole wall in at least three contact areas roughly equally spaced apart from each other, as measured around a circle drawn with the center axis of the borehole as the center point. As used herein, such circle is referred to as a "friction surface circle." In order that the stabilizer will remain in position after it has been inserted into the borehole, it should be understood that the friction surface circle, with the arc spanning a center angle of at least 180 degrees. It should be further understood that each friction surface 13 contacts the borehole wall over a length of arc on said friction surface circle, but contact at a friction surface can also occur only at a single point. As used herein such length of arc of contact on said friction surface circle is referred to a "contact arc length." Any arc distances between any two friction surfaces 13 herein are measured from the approximate midpoint of the respective contact arc lengths.

It can be understood that when the stabilizer is outside of the borehole, the diameter of the friction surface circle is greater than the diameter of the borehole. When stabilizer is within the borehole, the diameter of the friction surface circle is equal to the diameter of the borehole, as a result of the resilient compression f arms 15.

Figure 2:
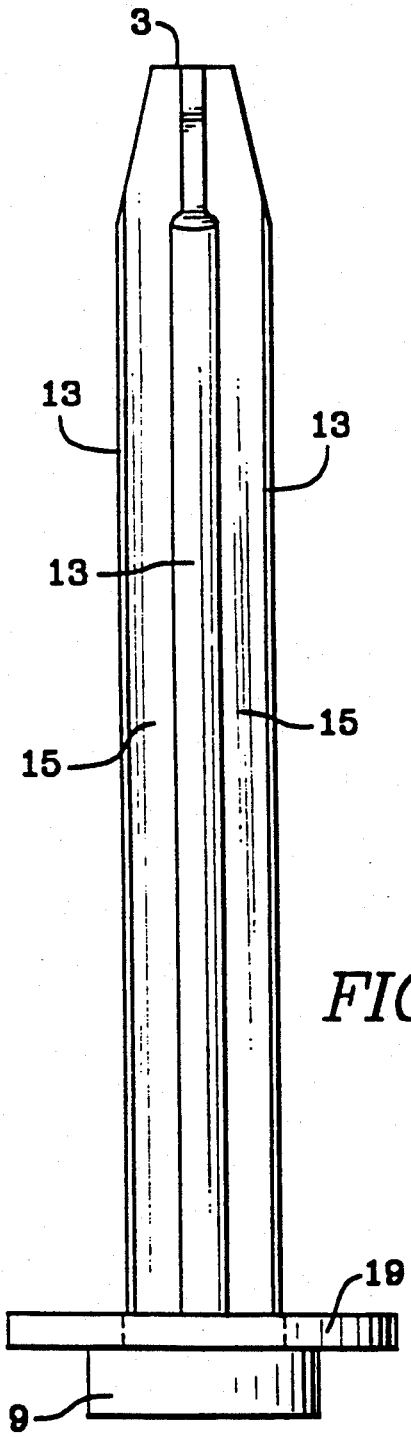
FIG. 2 is a front elevational view of the stabilizer of the invention.
Figure 3:
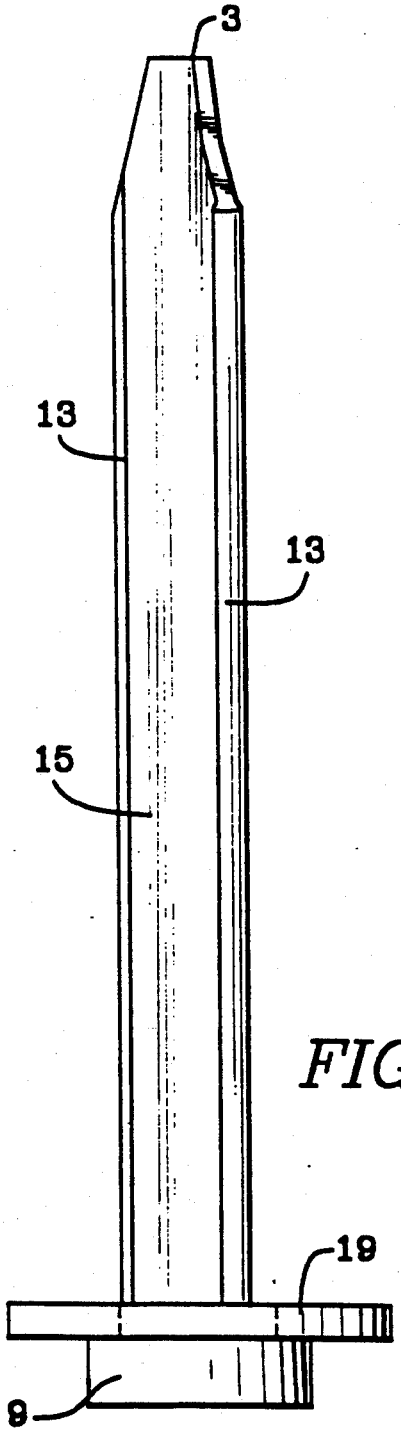
FIG. 3 is a side elevational view of the stabilizer of the invention.

Referring now to FIGS. 2 and 3, flange portion 9 is shown formed at the bottom end of spine 7. Flange 9 can be a separate piece, fastened by any conventional means, such as welding. Alternatively, flange 9 can be manufactured integrally with the spine 7 and arms 15, as by upset forging of the spine 7. I prefer flange 9 to be a solid member, but flange 9 can also be a hollow, tubular, member. Flange 9 has positioned around it a bearing plate 19. When stabilizer 1 is inserted into the borehole, flange 9 forces bearing plate 19 into contact with the earth structure being supported. Plate 19 distributes the axial load of stabilizer 1 over a larger surface for increased stability, as is well known. Flange 9 provides the structure against which conventional insertion devices act to drive stabilizer 1 into the borehole.

Figure 5:
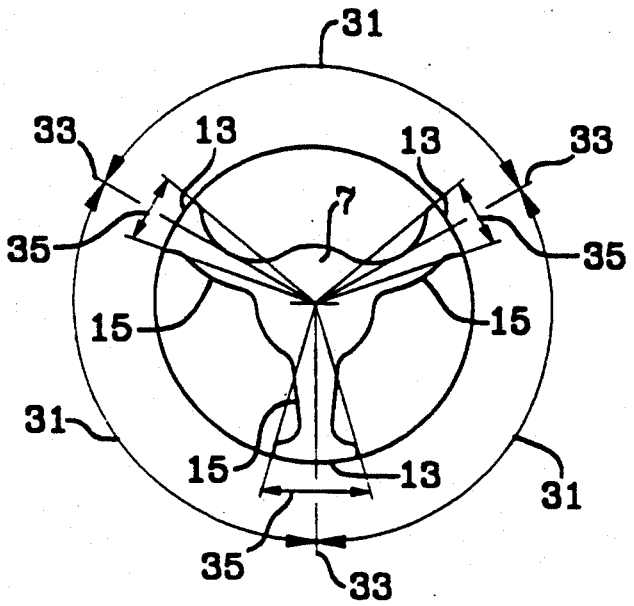
FIG. 5 is a top plan view of a preferred embodiment of the invention

FIG. 5 shows the preferred embodiment. Three support arms 15 are circumferentially spaced around spine 7 in approximately equal arc intervals. The center angle 31 between each contact surface 13 is 120 degrees, as measured between the approximate midpoints 33 of each contact arc length 35. It would be equivalent if the distance between each contact surface 13 were measured at the extreme edge of each contact arc length 35.

Figure 6:
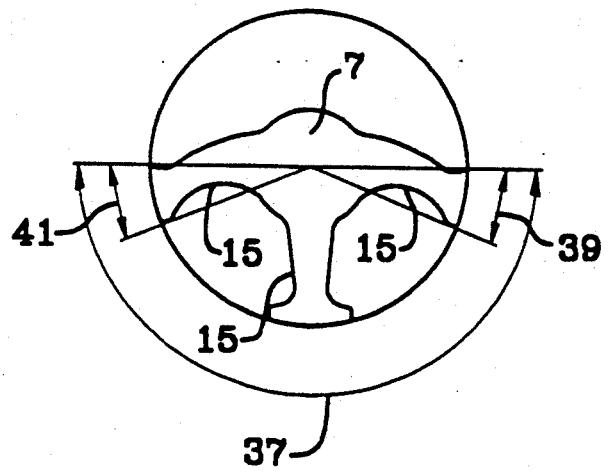
FIG. 6 is a top plan view of an outer limit embodiment of the invention.

FIG. 6 shows an alternate embodiment which is an outer limit of the spacing of the contact surfaces 13. The centerangle 37 spanning the arc on which all contact surfaces are positioned is 180 degrees, as measured from the extreme edge of contact arc lengths 39 and 41. If center angle 37 is less than 180 degrees, the stabilizer would not be significantly compressed against the borehole wall, and the stabilizer would tend to fall out of the borehole.

Without being bound to any particular theory of operation, I believe that the radial direction of resilient compression of arms 15 tends to concentrate the stresses in spine 7, and thereby provides for a different stress loading characteristic, as compared to prior art slitted stabilizers. Prior art slitted stabilizers experience a bending of the structure of the stabilizer generally parallel to the borehole wall, similar to a curved beam, and do not have any member adapted to exert a radial force outwardly toward the borehole wall, directly from the centerline of the borehole. I believe that this feature of stress pattern of the invention results in an extremely strong stabilizer. In addition, because of the presence of two distinct elements, the center spine 7 and the arms 15, I can select materials or manufacturing processes that provide a stabilizer with two distinct and independently variable strength characteristics: (1) longitudinal tensile strength of the spine 7, which affects the breaking strength of the stabilizer; and (2) compressive resistance of the arms 15, which affects the friction holding power of the stabilizer. Furthermore, I believe the invention permits the use of noncorrosive, light&weight materials for the stabilizer, such as aluminum or high strength plastic. Such materials may not ordinarily provide enough bending resistance in a simple, curved beam flexure mode, without excessive size or volume. However, such materials could provide sufficient force in a radial compressive mode to be effective as a stabilizer. These benefits can be important in that corrosion of the stabilizer can be avoided and the weight of stabilizer minimized. In addition, the combination of center spine 7 and radial arms 15 lends itself to an extrusion manufacturing process, which is a process commonly used with aluminum or plastic. The extrusion process can provide savings in cost of manufacture of the stabilizer.

Figure 7:
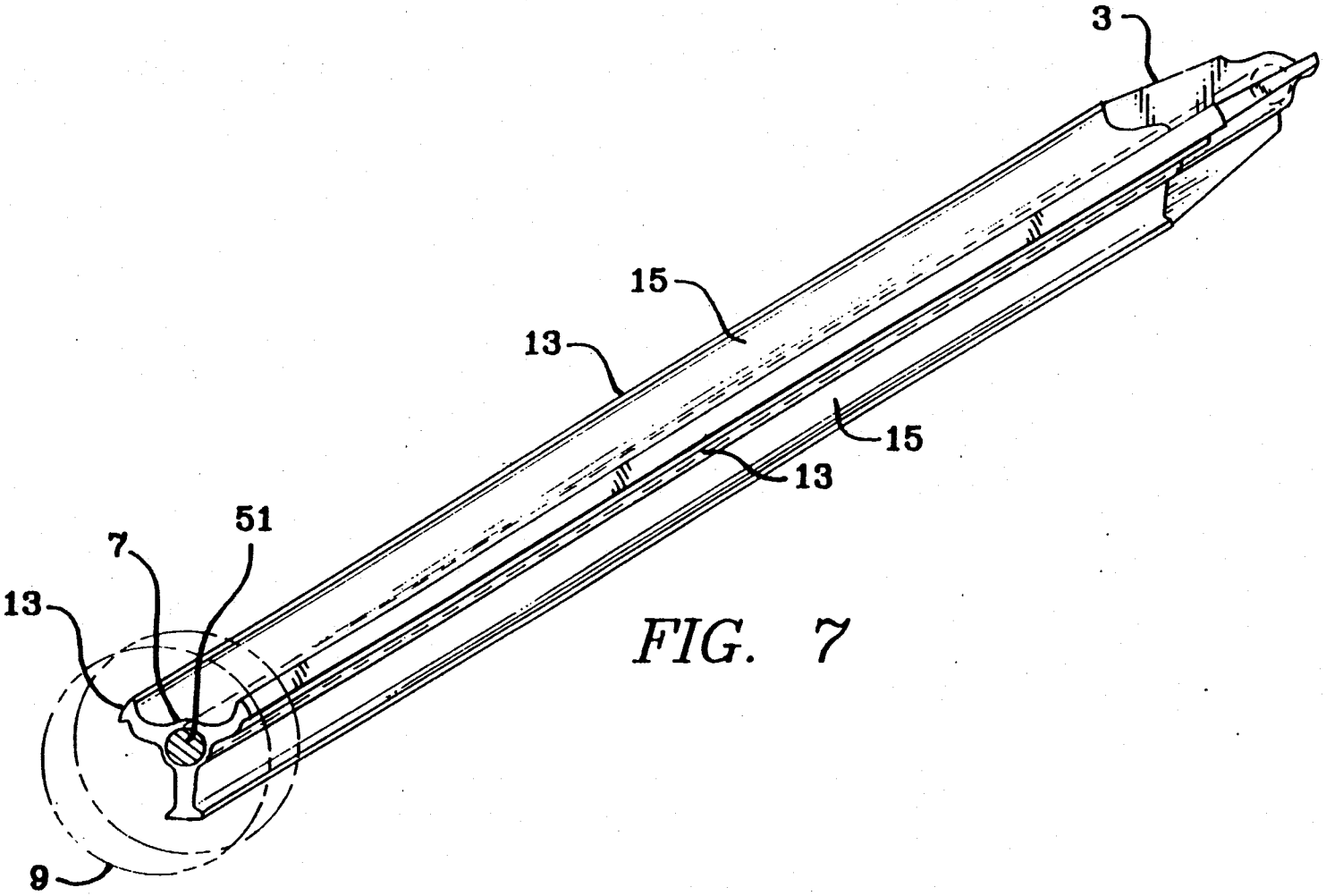
FIG. 7 is a perspective view of an alternate embodiment of the invention, with a bottom flange shown in phantom.

FIG. 7 shows an alternate embodiment which provides increased longitudinal tensile strength to stabilizers formed from plastic or aluminum. Center spine 7 includes reinforcing member 51 extending longitudinally along the length of spine 7, and embedded in the central portion of spine 7. Reinforcing member 51 can be frictionally fit into an aperture formed in central portion of spine 7, or, alternatively, can be fastened therein as by fusion or with suitable adhesives. Reinforcing member 51 can be high strength carbon steel, when stabilizer 1 is formed from a noncorrosive material such as aluminum or plastic.

While I have shown the invention with three support arms 15, any greater number of such arms 15 can also work. However, I believe that fewer than three support arms 15 would tend to result in undesirable anisotropic stiffness characteristics in the stabilizer. Furthermore, I believe that fewer than three support arms 15 will not provide the benefits of compressive force in a radial direction, along with the overall strength and stability of the invention as described hereinabove.

Having described the invention, what is claimed is:

1. A friction rock stabilizer, for use in a borehole having a longitudinal center axis and a substantially circular cross section transverse to said center axis, comprising:

a. an elongated, nondeformable center spine having a top end and a bottom end, said nondeformable spine adapted to extend within said borehole adjacent to said longitudinal center axis;

b. support arm means extending transversely outwardly from said nondeformable spine, for exerting a radial force outwardly from said center axis toward a borehole wall, for urging at least three spaced-apart friction surfaces into contact with the borehole wall, said friction surfaces having therebetween a portion of said nondeformable spine spaced from the borehole wall, when said stabilizer is positioned within the borehole;

c. said friction surfaces being positioned on an arc of a circle measured around said center axis, said arc spanning a center angle of at least 180 degrees;

d. said support arm means extending longitudinally along said nondeformable spine; and e. compression means on said support arm means for permitting resilient compression of said support arm means and for transmitting compressive stress in a radial direction between said friction surfaces and said nondeformable spine, during insertion of said stabilizer into an undersized borehole.

2. The invention of claim 1 in which said support arm means comprises a support arm extending between each of said friction surfaces and said nondeformable spine.

3. The invention of claim 2 in which said compression means comprises at least one of said support arms being resiliently deformable upon insertion of said stabilizer into an undersized borehole.

4. The invention of claim 3 in which at least one of said deformable support arms includes an angular elbow portion at which resilient deformation can occur.

5. The invention of claim 4 in which said circle on which said friction surfaces are positioned:

(a) has a diameter larger than the diameter of the borehole, when said stabilizer is outside of the borehole; and (b) has a diameter equal to the diameter of the borehole, when said stabilizer is within the borehole.

6. The invention of claim 4 in which said support arm means adjacent said top end of said nondeformable spine forms a tapered end.

7. The invention of claim 5 in which said bottom end of said nondeformable spine has affixed thereto a flange.

8. The invention of claim 7 in which said nondeformable spine includes a reinforcing member in the central portion thereof, said reinforcing member extending along the length of said nondeformable spine, and positioned entirely within said nondeformable spine.

9. The invention of claim 3 in which said friction surfaces are spaced apart from each other by a center angle of about 120 degrees.

10. The invention of claim 1 in which said stabilizer is provided from a light weight and noncorrosive material selected from a group consisting essentially of aluminum and high strength plastic.

11. A friction rock stabilizer, for use in a borehole having a longitudinal center axis and a substantially circular cross section transverse to said center axis, comprising:

a. an elongated, nondeformable center spine having a top end and a bottom end, said nondeformable spine adapted to extend within said borehole adjacent to said longitudinal center axis;

b. support arm means extending transversely outwardly from said nondeformable spine, for exerting a radial force outwardly from said center axis toward a borehole wall, for urging at least three spaced-apart friction surfaces into contact with the borehole wall, said friction surfaces having therebetween a portion of said nondeformable spine space from the borehole wall, when said stabilizer is positioned within the borehole;

c. said friction surfaces being positioned on an arc of a circle measured around said center axis, said arc spanning a center angle of at least 180 degrees;

d. said support arm means extending longitudinally along said nondeformable spine;

e. compression means on said support arm means for permitting resilient compression of said support arm means and for transmitting compressive stress in a radial direction between said friction surfaces and said nondeformable spine, during insertion of said stabilizer into an undersized borehole; and f. said nondeformable spine and said support arm means having different and independently variable longitudinal tensile strength and compressive strength characteristics.

* * * * *